United States Patent [19]
Wang
[11] 4,227,928
[45] Oct. 14, 1980

[54] COPPER-BORON CARBIDE COMPOSITE PARTICLE AND METHOD FOR ITS PRODUCTION

[75] Inventor: Chih-Chung Wang, Lexington, Mass.

[73] Assignee: Kennecott Copper Corporation, New York, N.Y.

[21] Appl. No.: 901,843

[22] Filed: May 1, 1978

[51] Int. Cl.[2] ..... B22F 5/00; B22F 3/00; C22C 29/00

[52] U.S. Cl. ..... 75/238; 75/203; 75/204; 75/212; 75/214; 75/226; 428/570

[58] Field of Search ..... 75/203, 204, 212, 214, 75/226, 238; 428/570

[56] References Cited

U.S. PATENT DOCUMENTS

| | | | |
|---|---|---|---|
| 1,986,197 | 1/1935 | Harshaw | 75/212 |
| 2,033,240 | 3/1936 | Hardy | 75/212 |
| 2,200,258 | 5/1940 | Boyer | 75/238 |
| 3,367,398 | 2/1968 | Riley et al. | 75/212 |
| 3,838,982 | 10/1974 | Sanderow et al. | 75/212 |

*Primary Examiner*—Brooks H. Hunt
*Attorney, Agent, or Firm*—John L. Sniado; Anthony M. Lorusso

[57] ABSTRACT

A process for manufacturing radiation shield structures of the type consisting of neutron absorbing boron carbide particles embedded in a copper matrix. The material comprises a multiplicity of particles comprising a core of boron carbide, a film of electroless copper bonded to the carbide, and a relatively thick electrodeposited copper layer bonded to the film. The particles are then consolidated to produce shield structures by hot rolling or hot pressing, with or without sintering.

11 Claims, 7 Drawing Figures

COPPER-BORON CARBIDE COMPOSITE PARTICLE AND METHOD FOR ITS PRODUCTION

BACKGROUND OF THE INVENTION

Broadly, this invention relates to a process for encapsulating particulate materials within copper metal to produce copper coated composite particles suitable for use in fabricating filled copper structures. More specifically, the invention is directed to a process for encapsulating boron carbide particles within electrodeposited copper of high density. The primary use for such particles is the fabrication of containers designed for storage, disposal, or transportation of nuclear waste materials and other radioactive, radiation emitting (e.g., neutron emitting) substances.

One of the known containers for housing neutron-emitting nuclear waste materials comprise a solid aluminum mass containing a plurality of baskets for containing the waste material. Each basket is lined with boron carbide ($B_4C$) filled copper plates. Copper is the metal of choice because of its high specific heat high thermal conductivity and high melting point. Boron carbide is used as a filler because it is characterized by a high capture cross section for neutrons.

The ideal boron carbide filled copper plate material for use in fabricating these and other types of containers designed for housing nuclear wastes would be a substantially pure, dense, matrix of copper metal, tightly bonded to a uniformly dispersed boron carbide phase consisting of a multiplicity of carbide particles arranged within the copper matrix such that no straight line passing through the plate fails to impinge upon a boron carbide particle. A high loading of boron carbide plus a uniformly dispersed copper phase are thus desirable. This can be achieved most readily by the electroplating process described in this invention.

SUMMARY OF THE INVENTION

The instant invention provides a novel product and a novel approach to fabricating boron carbide filled copper structures of the type set forth above which uses the product. The process of the invention is preferably practiced using boron carbide particulate material, and this material will be discussed exclusively throughout this specification. However, it will be apparent to those skilled in the art that the techniques herein described will be readily applicable to producing copper structures filled with substantially any desired particulate material.

In accordance with a first aspect of the invention, there is provided a process for encapsulating particulate core materials within copper metal to produce discrete particles suitable for use in fabricating core material-filled copper structures having a selected copper to core material volume ratio. For a core material having high resistivity, the process comprises first the steps of placing the particulate core material in a solution for electroless copper plating. Such solutions are available commercially from sources such as the Shipley Company, Newton, Massachusetts. Electroless plating effects the deposition of a thin, electrically conductive film of copper metal on the core material. Thereafter, additional copper is electrolytically deposited onto the particles by employing the conductive film coated particles as the cathode of a copper electroplating cell. The electrolytic deposition is continued until the volume of the electroplated copper is at least 10 times the volume of the copper film. The copper to core material volume ratio may readily be controlled simply by terminating the electrodeposition when the desired quantity of copper has been deposited. The preferred copper to core material volume ratio is within the range of 0.3 to 4, and the preferred nonconductive particle is boron carbide.

These encapsulated particles are ideally suited for further treatment, such as hot rolling or hot pressing techniques, or cold pressing plus sintering, and can be used to produce dense, boron carbide-filled copper shield structures of any desired shape. The electroplating process can be done in a conventional barrel plating unit, in a mechanically agitated bed, or in a fluidized bed.

In one important embodiment of the process, the agitating step is effected by placing the solution/core particle mixture in a cylindrically shaped container having a longitudinal axis and a bottom surface describing at least a portion of a cone whose axis is coincident with the longitudinal axis. When such a container is oriented such that the axes define an acute angle with the vertical, rotation of the container about the axis exposes the surfaces of the core particles uniformly to the copper electroplating solution, avoids coagulation of the particles, and overcomes the problems which arise in subsequent processing steps when carbide particles in certain sections of the solution are not coated with the film.

In accordance with another aspect of the invention, a raw material is provided for producing copper, boron carbide-filled neutron absorbing shield structures. The material comprises a multiplicity of particles suitable for being combined to form a unitary structure by rolling, pressing, sintering or the like. Each particle comprises a core comprising boron carbide and a layer of electrodeposited copper metal surrounding the core, the copper to boron carbide volume ratio being within the range of 0.3 to 4.

In accordance with another aspect of the invention, there is provided a process for producing a neutron absorbing, high specific heat shield structure. The process comprises the steps of providing a multiplicity of particles each of which comprise a core of boron carbide and a coating of electrodeposited copper metal, the average copper to boron carbide volume ratio of the particles being within the range of 0.3 and 4, and consolidating the particles by hot rolling or pressing, or by sintering, to produce a structure having a thickness sufficient to provide a boron carbide particle intercepting all lines passing therethrough.

Accordingly, objects of the invention include the provision of a copper coated boron carbide particle well suited for use as a raw material in the fabrication of shield structures for use in nuclear waste material containers.

Another object of the invention is to provide a method for electrodepositing any selected quantity of copper on nonconductive core particles.

Another object of the invention is to provide a method for producing nuclear shield structures.

These and other objects and features of the invention will be apparent to those skilled in the art from the following description of some preferred embodiments and from the drawing.

DESCRIPTION OF THE PREFERRED EMBODIMENTS

Boron carbide is commercially available in various particle sizes from, for example, the Carborundum Company of Niagara Falls, New York. The electrical resistivity of this material is quite high, on the order of $10^4$ to $10^8$ μohm-cm, and this leads to difficulties if one attempts to incorporate the carbide as a filler in a copper matrix by conventional electrodeposition techinques. Furthermore, electrodeposition techniques generally result in excellent copper-substrate bonding. Thus, while electrodeposition would be an excellent method of encapsulating neutron absorbing boron carbide particles, a method of building up a copper coating by this technique has not been forthcoming.

In accordance with the invention, copper electrodeposition on discreet boron carbide particles is made possible by first plating a thin, electrically conductive film of copper by electroless methods, and thereafter employing the thin film as a conductor layer to build up a relatively much thicker coating of electrodeposited copper on the particles. The copper to boron carbide volume ratio is controlled, generally within the range between about 0.3 and 4, so that sufficient copper is present to enable the particles to be consolidated together by conventional sintering, rolling, or pressing operation without leaving voids, yet there is not enough copper present to result in a structure having an undesirably low carbide particle concentration. The copper encapsulated particles may accordingly be used as a raw material to produce copper boron carbide filled barrier layers suitable for fabricating nuclear waste containers.

Processes for the electroless plating of metal such as copper on a nonconductive surface such as glass are known. A suitable procedure for the electroless plating of copper on such nonconductors appears in the book entitled "Copper and Copper Alloy Plating" by R. Pinner, B. SC. That publication states that a great many reducing agents have been proposed for the deposition of copper, including hydrazine sulphate, hydroxylamine, formate, copper hydride, nascent hydrogen, acetylide derivatives and carbonyl, but industrial processes have been mainly confined to those based on modified Fehling's solutions.

A copper film can be applied to boron carbide particles by means of an electroless plating solution made up of two parts:

| | | |
|---|---|---|
| Copper Solution A | | |
| Copper Sulphate | 64 g | 2.25 oz |
| Nickel Chloride | 19 g | 0.65 oz |

-continued

| | | |
|---|---|---|
| Formaldehyde | 240 cm | 0.65 gal |
| Water | 1 gal | |
| Reducing Solution B | | |
| Sodium Hydroxide | 48 g | 1.7 oz |
| Rochelle Salt | 208 g | 7.3 oz |
| Sodium Carbonate | 19 g | 0.65 oz |

The ingredients of Solution B are dissolved in 840 $cm^3$ water and made up to 1 gal in a bottle which has been coated inside with a resistant black paint or with melted paraffin wax (for solutions not be kept more than one week).

Figure 1A:
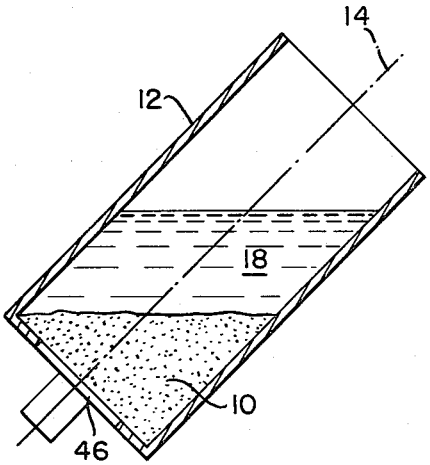
FIG. 1*a* illustrates the electroless copper deposition of the process of the invention.

In accordance with the present invention, Copper Solution A and Reducing Solution B are added in equal volumes to the container of FIG. 1A along with the boron carbide particles to be plated. The reactants are allowed to contact each other for 20 or 25 minutes at 20° C. to produce the copper plated boron particles.

At this point is should be noted that it is preferred to use a commercial electroless copper plating solution. One suitable electroless copper plating solution is sold by the Shipley Company of Newton, Mass. 02162 under their designation Cuposit TM Pm-990 electroless copper. The boron carbide particles can be plated with a thin film of copper by following the procedure accompanying the Cuposit TM PM-990 bath.

During the electroless plating of copper onto the particles, a moderate agitation of the particles in the solutions should be provided. Additional copper can be electrolytically deposited onto the particles employing the conductive film as the cathode of a copper electroplating cell. As long as this film is adherant, how thick it is is not important. Submicron thick is perfectly acceptable.

The particle size of the boron carbide may vary widely. The preferred particle sizes are between about No. 8 and No. 50 grit, one example is to use No. 10 grit boron carbide particles.

Figure 1B:
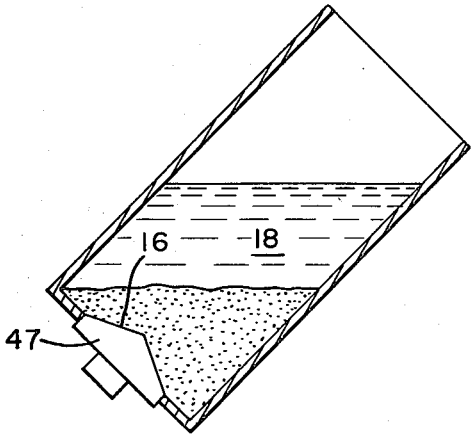
FIG. 1*b* illustrates the step of FIG. 1*a* employing a first variation in the design of the reaction container.
Figure 1F:
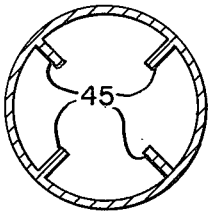
FIG. 1*f* in a cross-sectional view of the reaction container of FIG. 1*c* taken at lines 1*f*–1*f*.
Figure 1C:
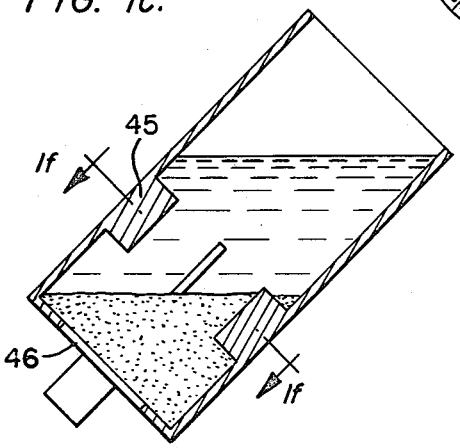
FIG. 1*c* illustrates the step of FIG. 1*a* using a second variation in the design of the reaction container.
Figure 1D:
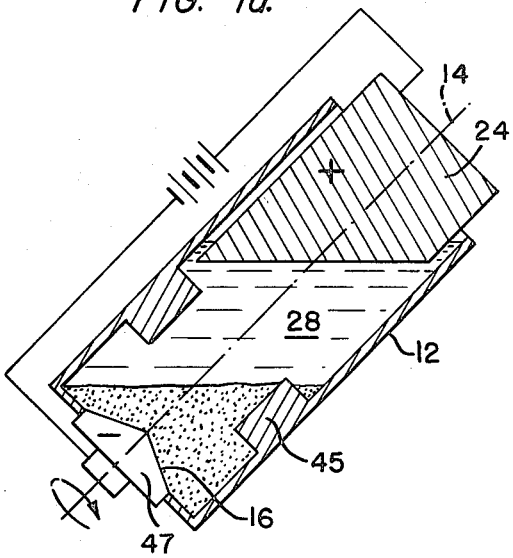
FIG. 1*d* illustrates the electrolytic copper deposition of the process of the invention.
Figure 1E:
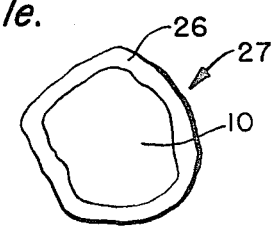
FIG. 1*e* is a cross-sectional view of a particle made in accordance with the process of the invention.

In the plating step as shown in FIG. 1*a*, the boron carbide particles 10, together with electroless plating solution 18, are placed in a cylindrically shaped container 12 having a longitudinal axis 14. If the container is tipped at an acute angle to the vertical, e.g., 30°, simple axial rotation about axis 14 uniformly turns over and agitates the particulate carbide. In another preferred arrangement as shown in FIG. 1*b*, the container has a bottom surface 16 describing a conical or frustoconical surface shape which makes an angle with the bottom, e.g. 15°. This arrangement reduces the stagnant region. As an additional improvement (FIG. 1C) fins 45 are added to help further mixing of the particles. Accordingly, the use of a container as illustrated overcomes the problems of coagulation or unequal plating due to nonuniform exposure to the solution.

During the electrolytic deposition the container is fitted with an anode 24. The bottom 46 or 47 serves as the negative pole. The electroless plating solution is decanted and a copper electroplating solution 28 is added to the container 12 in quantities sufficient to contact anode 24. A current passed through the solution 28 results in efficient electrodeposition of a substantial thickness of copper 26 about the discrete, copper film-covered carbide particles. The mean volume of copper metal deposited on the particles is dependant on the plating characteristics of the electrochemical cell.

| Ememplary conditions are as follows: | |
|---|---|
| Duration of electrodeposition | 14 hours |
| Current density | 60 mA per $cm^2$ |
| Concentration of Solution | 1 mole of copper sulfate plus 1 mole of sulfuric acid |
| Temperature of Solution | 50° C. |

The thickness of the electrodeposited layer 26, at a given current density and solution concentration, is proportional to the duration of the treatment. Accordingly, it is a simple matter to vary the volume of copper deposited on the individual carbide particles. The copper to carbide volume ratio is important for the following reasons. If the ratio is too low, then attmepts to consolidate a plurality of the particles into a unitary structure filled with the carbide will result in a product having a significant void volume and thus lacking in structural integrity. On the other hand, too much copper results in a substantially void-free product after consolidation, but the carbide particles are not present in adequate concentration to provide a neutron absorbing barrier layer in a reasonably thin sheet of material. One preferred copper/boron carbide ratio for the particles of the invention is 0.33.

Figure 2:
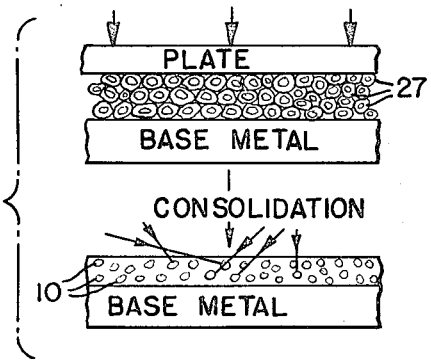
FIG. 2 is a schematic diagram illustrating an exemplary use for the particle of the invention.

In accordance with another aspect of the invention, the particles produced as described above are used in the fabrication of neutron absorbing shield structures such as plates, coatings, and the like having a thickness sufficient to provide a boron carbide particle intercepting all lines passing through the structure. FIG. 2 broadly illustrates the technique. A multiplicity of the finished particles 27 are placed in closepacked relation, for example, on a metallic base material made of stainless steel, or on a base material coated with electrodeposited copper to optimize bonding, and the particles are fused to produce an integral layer of barrier material. While various techniques may be employed in the consolidation process, the particle aggregate should not be subjected to a temperature above the melting point of copper, as this would result in heterogeneous distribution, agglomeration, and/or settling of the carbide particles. Rather, consolidation is effected by sintering, hot rolling, or hot pressing.

One procedure for making a shield is to provide a mold having a void space in the configuration of the shield. The mold can be formed of a metal such as stainless steel. The mold is then filled with particles 27 and capped with a stainless steel plate. The stainless steel plate is placed on top of the particles 27 at 2000 psi while the mold is heated to 800° C. for 2 minutes. The 2000 psi pressure is maintained until the resulting plate reaches room temperature (20° C.). The foregoing procedure results in a 30% reduction in the volume of the particles and produces a neutron absorbing plate.

The particular method of consolidation selected will depend upon the shape and thickness of the desired structure. A base material, of course, need not necessarily be employed, and it is contemplated that a copper jacket or a die may be used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A process for encapsulating particulate boron carbide core materials within copper metal to produce discrete particles suitable for use in fabricating boron carbide core material-filled copper structures having a selected copper/boron carbide core material volume ratio, said process comprising the steps of:

(A) placing the particulate boron carbide core material in a copper containing solution suitable for electroless copper plating and electrolessly plating an electrically conductive film of copper metal on said boron carbide core material to produce copper coated boron carbide particles;

(B) electrolytically depositing additional copper onto said copper coated boron carbide particles; and (C) terminating the electrodeposition when particles of copper coated boron carbide having a selected copper/boron carbide core material volume ratio is achieved.

2. The process as set forth in claim 1 wherein the selected copper/boron carbide ratio is within the range of 0.3 to 4.

3. The process as set forth in claim 1 wherein the step (A) is effected by:

placing the solution-boron carbide core particle mixture in a cylindrically shaped container having a longitudinal axis and a bottom surface describing at least a portion of a cone whose axis is coincident with said axis;

orienting said container so that said axes define an acute angle with the vertical; and rotating said container about said axes.

4. A material for producing copper, boron carbidefilled, neutron abosrobing shield structures, said material comprising a multiplicity of particles suitable for being fused to form a unitary structure by rolling, pressing, or sintering, each said particle comprising:

a core particle of boron carbide;

a thin film of electroless copper bonded to said core particle; and a layer of electrodeposited copper metal bonded to said film and encapsulating said core particle, the copper/boron carbide volume ratio being within the range of 0.3 to 4.

5. A process for producing a neutron absorbing, shield structure, said process comprising the steps of:

(A) placing a particulate boron carbide core material in a copper containing solution suitable for electroless copper plating and electrolessly plating an electrically conductive film of copper metal on said boron carbide core material to produce copper coated boron carbide particles;

(B) electrolytically depositing additional copper onto said copper coated boron carbide particles;

(C) terminating the electrodeposition when particles of copper coated boron carbide having a copper/-boron carbide core material volume ratio between the range of 0.3 to 4 is achieved; and, (D) consolidating said particles of copper coated boron carbide to produce a structure having a thickness sufficient to provide a boron carbide particle intercepting all lines passing therethrough.

6. The process as set forth in claim 5 wherein said consolidation step is effected by sintering.

7. The process as set forth in claim 5 wherein said consolidation step is effected by rolling.

8. The process as set forth in claim 5 wherein said consolidation step is effected by hot rolling.

9. The process as set forth in claim 5 wherein said consolidation step is effected by pressing.

10. The process as set forth in claim 5 wherein said consolidation step is effected by hot pressing.

11. The process as set forth in claim 5 wherein the boron carbide particle size is within the range of No. 8 and No. 50 grit.

* * * * *